US005846479A

United States Patent [19]

English

[11] Patent Number: 5,846,479

[45] Date of Patent: Dec. 8, 1998

[54] APPARATUS FOR DE-GASSING MOLTEN METAL

[75] Inventor: Christopher John English, Guelph, Canada

[73] Assignee: Cast House Technology Ltd., Guelph, Canada

[21] Appl. No.: 855,629

[22] Filed: May 14, 1997

[30] Foreign Application Priority Data

May 15, 1996 [GB] United Kingdom ..... 9610180

[51] Int. Cl.[6] ..... C21B 7/16

[52] U.S. Cl. ..... 266/47; 266/217; 266/220; 222/603

[58] Field of Search ..... 266/217, 220, 266/227, 275, 200, 44, 47; 222/603, 590

[56] References Cited

U.S. PATENT DOCUMENTS

| | | | |
|---|---|---|---|
| 3,689,048 | 9/1972 | Foulard et al. | 266/220 |
| 3,904,180 | 9/1975 | Bass et al. | 266/220 |
| 4,179,102 | 12/1979 | Clumpner | 266/218 |
| 4,317,679 | 3/1982 | Dantzig et al. | 266/217 |
| 4,670,050 | 6/1987 | Ootsuka et al. | 75/68 R |
| 4,744,545 | 5/1988 | McDonald et al. | 266/227 |

FOREIGN PATENT DOCUMENTS

| | | |
|---|---|---|
| 1108412 | 8/1989 | Canada . |
| WO 92/10595 | 6/1992 | WIPO . |
| WO 95/21273 | 8/1995 | WIPO . |

OTHER PUBLICATIONS

Light Metals 1991; The Minerals, Metals & Materials Society, Feb. 1990.

Light Metals 1996; The Minerals, Metals & Materials Society, Feb. 1996.

*Primary Examiner*—Scott Kastler

*Attorney, Agent, or Firm*—Anthony Asquith & Co.

[57] ABSTRACT

Argon injection nozzles are provided in a close-spaced series lengthwise along a treatment trough, in which liquid aluminum is conveyed. The gas is blown in at high Reynolds No, whereby the jets break up into small bubbles. A high average bubble population density is achieved over the whole volume of liquid metal in the treatment trough. De-gassing is achieved in a metal residence time of 15 to 60 seconds, whereby the trough in which treatment takes place can be small.

34 Claims, 4 Drawing Sheets

APPARATUS FOR DE-GASSING MOLTEN METAL

This invention relates to the removal of dissolved gas, such as hydrogen, from a molten liquid metal, such as aluminum, emerging from a furnace.

BACKGROUND TO THE INVENTION

De-gassing of aluminum and other metals is achieved by bubbling a gas such as the inert gas argon through the hot liquid metal. The argon bubbles accept the hydrogen out of solution, and carry the hydrogen bodily out of the liquid metal. Degassing is important because hydrogen left in the metal can cause voids and other imperfections in castings.

The invention is aimed at improving the manner in which de-gassing is carried out, to the extent that the equipment needed to achieve a given de-gassing performance is considerably smaller and less costly than has been the case hitherto.

THE PRIOR ART

Some previous designs of de-gassing facilities are shown in patent publications U.S. Pat. No. 4,179,102 (Clumpner, 1979); WO-92/10595 (English, 1992); CA-1,108,412 (Alcan, 1979); WO-95/21273 (Alcan, 1995); U.S. Pat. No. 4,670,050 (Ootsuka, 1987).

Other relevant publications are: *The Heated Mint IIIE*, by English & Rogers, published in Light Metals 1991 (Proceedings of the technical sessions presented by the TMS Light Metals Committee at the 120th TMS Annual Meeting, New Orleans, Feb. 17–21, 1991; and also *The Alcan Compact De-Gasser: A Trough-based Aluminum Treatment Process* by Waite & Thiffault, published in Light Metals 1996, by The Minerals Metals & Materials Society

THE INVENTION IN RELATION TO THE PRIOR ART

One of the keys to de-gassing performance is the size of the bubbles. The smaller the argon bubbles, the greater the aggregate surface area of all the bubbles, for a given volume of supplied argon gas, and the greater the area through which the hydrogen can be gathered into the argon bubbles.

There are basically three conventional modes of producing small bubbles. These are: 1. causing the nozzles to move (spin) mechanically, under the surface of the liquid metal, which causes the bubbles of argon emerging from the nozzles to break up; 2. blowing the argon gas through a block of porous material, which disperses the argon into small bubbles according to the pore size; and 3. blowing the argon gas through the nozzle at a high Reynolds Number (RN).

This latter mode requires more careful design of the nozzles, but a major benefit over mode 1 is that there are no moving parts in the liquid metal, to be sealed and guided; and a major benefit over mode 2 is that the small bubbles can be so concentrated as to lead to a high bubble population density.

It has been found that placing high-RN nozzles close together can produce in the liquid metal being treated a significantly higher average bubble population density over a large volume of the liquid metal, than has been possible hitherto. In fact, it has been found that a concentration of nozzles, placed close together in a treatment zone, can so fill the liquid metal in the treatment zone with small bubbles that excellent de-gassing of the liquid metal is achieved.

It has been found that the residence time the liquid metal needs to spend in passing through the treatment zone can be as low as about fifteen seconds, if the treatment zone is filled to a high-average-density with small bubbles of argon. A residence time of one minute would be ample in virtually every case. (This residence time may be compared with prior art de-gassing reactors, in which residence times (i.e the time the molten aluminum spends in the de-gassing reactor) are generally reckoned in the several minutes.

It may be noted that it is the average bubble population density over a whole volume that is important. Any nozzle system of course will produce a high bubble population density just near the nozzle: but the key to efficient de-gassing is to flood a whole large volume with a high population density of small bubbles, and for that, as mentioned, the provision of several closely-spaced nozzles is important.

As to the size of the treatment zone, it may be noted that it is typical, in casting systems, for the liquid metal to flow along the troughs, from the furnace to the casting moulds, at a speed in the order of about 150 cm/minute. In fifteen or twenty seconds, the liquid metal would flow less than one metre. Thus, when degassing is done by filling a whole treatment volume of the liquid metal to a high bubble population density, with small bubbles, it turns out that the size of the treatment volume required occupies, in many cases, less than a metre of trough length, and the de-gassing can be done on a straight-pass-through basis, in line, in the trough.

It is relatively inexpensive to engineer a one-metre trough-length as a treatment zone. It is recognised that filling the liquid metal in the zone with small bubbles to a high bubble population density can be done by providing several nozzles operating at high RN, closely spaced along the length of the trough, in the treatment zone. The key to achieving de-gassing in such a small (and therefore inexpensive) treatment zone lies in filling more or less the whole volume of liquid metal in the zone with small bubbles to a high bubble population density.

The vigorous movements of the bubbles in the liquid metal make it unnecessary to stir the liquid. The liquid is kept in such vigorous motion by the swirling bubbles as to ensure there are no "dead" regions in the treatment zone, and to ensure that treatment is carried out equally effectively over the whole bubble-filled zone.

Of course, the engineered treatment zone is more costly than the corresponding length of plain trough. But compared with previous engineered de-gassing treatment facilities, a treatment zone that simply takes the place of a short length of plain trough (and which requires no moving parts) represents a huge cost saving.

The benefits of improving the overall average bubble population density can be used either to reduce the size of the equipment needed, or to improve the de-gassing performance, or both.

GENERAL FEATURES OF THE INVENTION

The invention lies in an apparatus for de-gassing molten metal. The apparatus includes a treatment-trough, made of refractory material, and a means for defining a gas-tight sealed treatment zone, in the treatment-trough. A flow of liquid metal passes through the treatment-trough, and through the treatment-zone. The treatment-trough is characterised as trough-shaped, in that the length of the treatment-zone in the treatment-trough is longer than the width and height of the treatment-trough. The treatment-trough is provided with a plurality of nozzles, and the nozzles are fixed into the material of the treatment-trough. The apparatus includes a flow of treatment-gas through the nozzles, and the flow of treatment-gas through the nozzles is of such high speed that the treatment-gas breaks up into streams of small bubbles in the liquid metal. The nozzles are disposed in line, in a series, lengthwise along the length of the treatment-trough, and are so spaced as to create a bubble-filled zone in the liquid metal in the treatment-zone, along the length of the trough.

DETAILED DESCRIPTION OF PREFERRED EMBODIMENTS

By way of further explanation of the invention, exemplary embodiments of the invention will now be described with reference to the accompanying drawings, in which:

Figure 1:
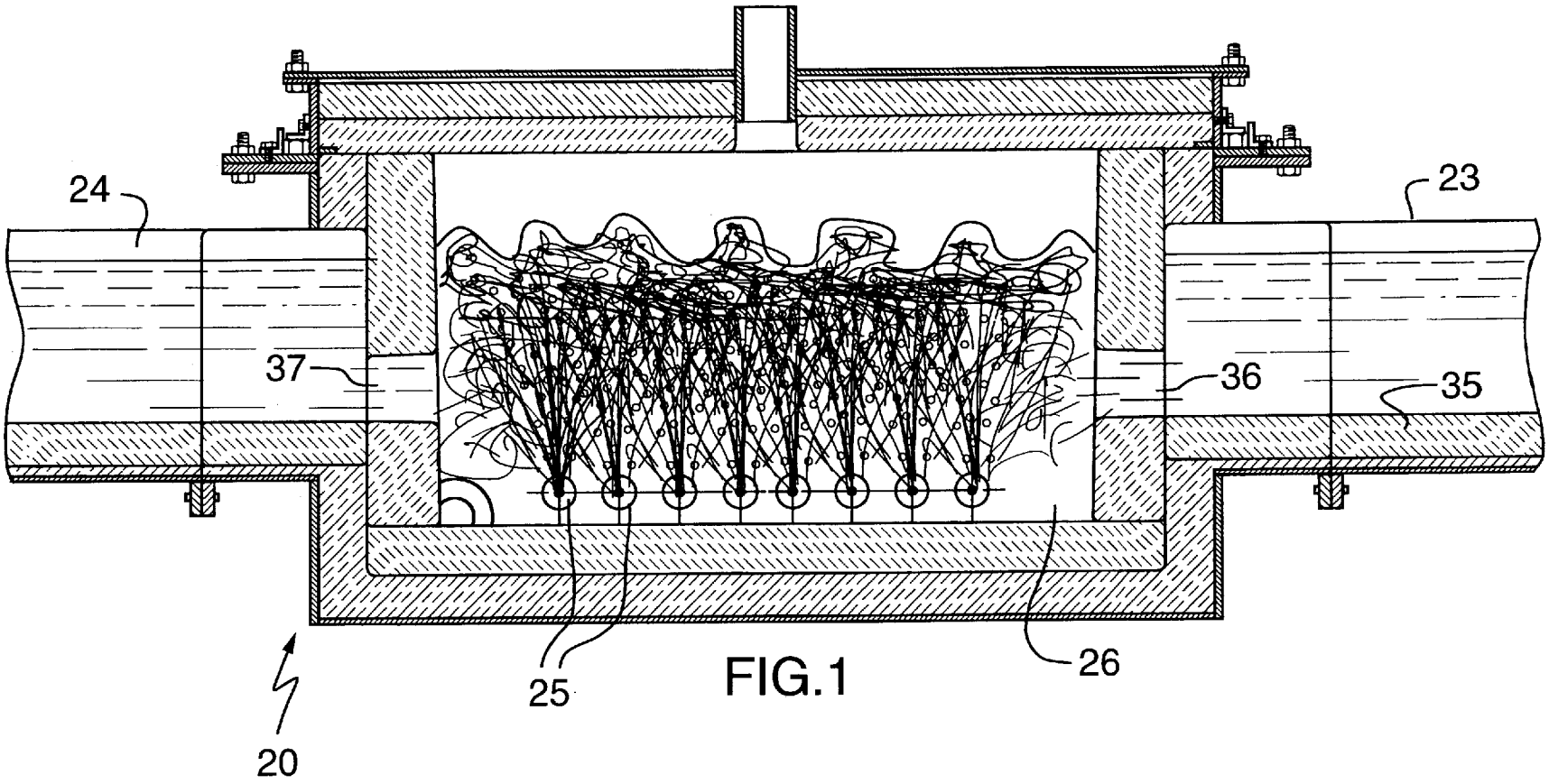
FIG. 1 is a cross-sectioned side elevation of a de-gassing treatment apparatus that embodies the invention.
Figure 2:
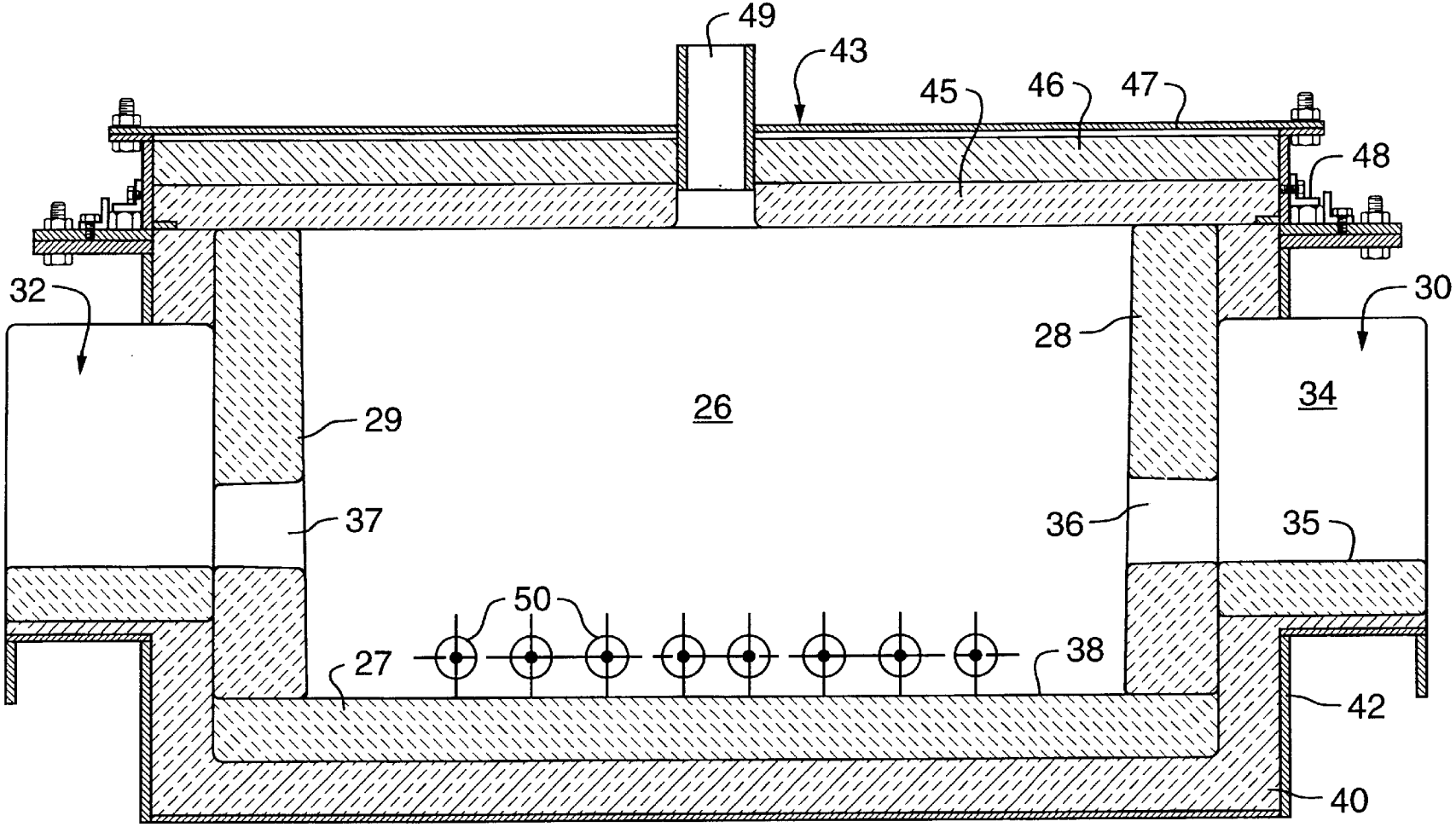
FIG. 2 is a close-up of an area of FIG. 1.
Figure 3:
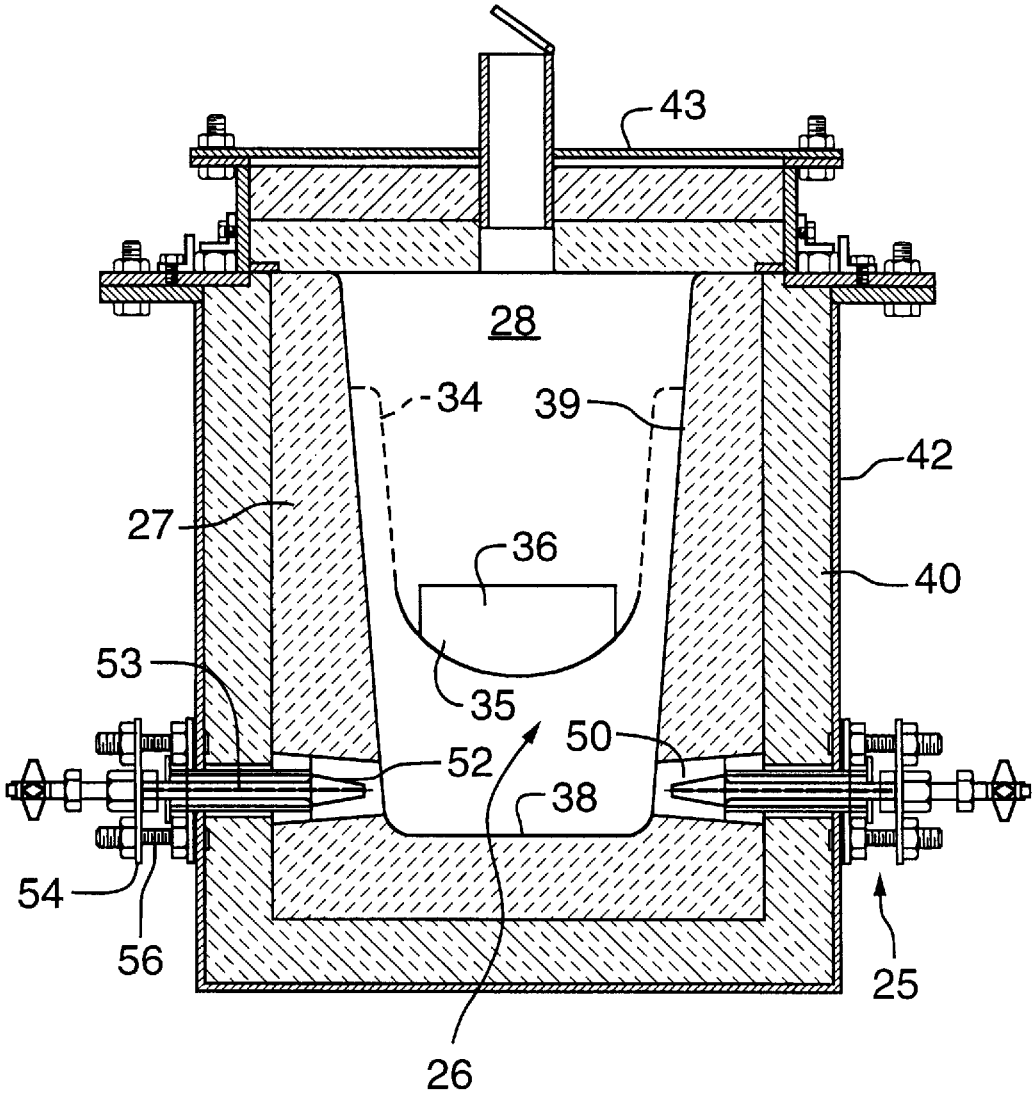
FIG. 3 is a cross-sectioned end elevation of the apparatus of FIG. 1.

The apparatuses shown in the accompanying drawings and described below are examples which embody the invention. It should be noted that the scope of the invention is defined by the accompanying claims, and not necessarily by specific features of exemplary embodiments.

The apparatus comprises a de-gassing trough unit 20. The de-gassing trough unit 20 is adapted to fit between the inlet-trough 23 in which liquid metal is conveyed from a furnace (to the right) and the outlet-trough 24 in which the liquid metal is fed to moulds (to the left).

The liquid metal in the inlet and outlet troughs 23,24 is at a depth, typically, of about 20 cm. (Actually, of course, the liquid surface at the inlet will be slightly higher than the liquid surface at the outlet, given that the liquid is flowing through the unit.)

Inside the unit 20, a gas such as argon is fed through nozzles 25 fitted into the walls of the treatment-trough 26. The gas is fed in with such vigour that the liquid contained in the treatment-trough 26 is in a state of high turbulence. The gas emerges from the nozzles 25 at such a Reynold's Number that the jet breaks up into streams of tiny bubbles. The gas jet is vigorous enough that the bubbles do not rise gently to the surface, but swirl and surge around violently in the liquid metal, thoroughly stirring the whole volume of liquid contained in the treatment-trough.

The construction of the de-gassing treatment-trough unit will now be described. The liquid metal is contained in a trough component 27, which is moulded in conventional ceramic refractory material. The ends of the trough component 27 are closed by inlet and outlet baffles 28,29. The baffles are shaped to fit snugly into the trough component 27, and are cemented in place.

The inlet and outlet baffles 28,29 are also cemented to inlet and outlet trough stubs 30,32. The inlet and outlet trough stubs are of a conventional cross-sectional shape, having steep side walls 34 and a large-radius floor 35. The inlet and outlet baffles 28,29 are provided with inlet and outlet ports 36,37, which communicate the treatment trough 26 with the inlet and outlet troughs. The ports 36,37 are well below the level of the liquid in the troughs, so no air or other gas can pass into or out of the treatment zone.

The treatment trough 26 defined by the trough component 27 is a little wider and deeper than the inlet and outlet troughs. The trough 26 has a flat floor 38, with only a small radiused corner at the junction between floor and wall. The trough 26 has steeply sloping side walls 39, the angle of the side walls being such as to allow a generous draught angle, both for moulding the ceramic trough component, and for removing any metal that might have become solidified in the trough.

It may be noted that the treatment trough 26 in fact is hardly any more difficult to reach into and to keep clean than the rest of the troughs for conveying the liquid metal from furnace to casting machines.

In the particular case illustrated, the length of the treatment trough, between the baffles, is 85 cm; the inside width of the trough (half way up) is 24 cm; and the height of the trough is 45 cm. The liquid depth in the trough would be set (nominally) to be about 20 cm, so that the volume of liquid metal contained in the trough is typically about 40 liters.

Such a trough is intended for a molten aluminum flow-rate of about 500 kg/min (185 liters/min). Generally, with the de-gassing system as described herein, the treatment trough can be built small enough that the volume of liquid actually in the treatment trough is the volume of only about 15 seconds of the liquid-metal-flow-rate. It may be noted that the required liquid residence time needed to complete the de-gassing is a measure of the efficiency of the de-gassing treatment. In the present case, as mentioned, de-gassing can often be completed in 15 seconds, and the parameters such as flow rates, size of the trough, etc, are engineered so as to give that residence time. The designer of course finds it prudent to allow some margin, to ensure that treatment will be completed even if some of the parameters might be less than ideal. Even so, however, with the system as described the designer can afford to engineer the system to a liquid residence time of less than one minute.

Surrounding the refractory material of the trough component 27 are some layers of insulation 40. The insulation also provides padded mechanical support for the refractory material. The structure of the unit is contained in an external metal case 42.

The treatment zone is enclosed by a lid 43. The lid includes a panel 45 of refractory material, covered with insulation 46, and a metal cover 47. The cover is secured to the metal case 40 by bolts, seals 48 being incorporated into the interface to ensure that the treatment zone is airtight. A port 49 allows excess gas from inside the treatment zone to escape. A pressure relief valve is provided on the port 49, to maintain a (slight) positive pressure in the treatment zone, to ensure no atmospheric air can enter the zone.

It may be noted that even just a trace of air inside the treatment zone would be a considerable contamination, because of the fact that the high bubble population density causes the surface of the liquid metal to be in motion, and foamy. If the surface were still, and a trace of air were present, only the immediate surface of the molten aluminum would be affected by oxidation, and the bulk of the liquid would be unaffected. But when the surface is violently in motion, and foamy, the surface cannot protect the bulk of the liquid, and oxidation effects would be quite extensive. Therefore, it is especially important in the case of the high-bubble-density, violently-foaming, system to ensure complete exclusion of any trace of air from the treatment zone.

Also, another reason for ensuring that the zone is strictly sealed is that if any water vapour (e.g from the atmosphere) were to find its way into the treatment zone, the hydrogen therefrom might lead to a reduction in the rate of hydrogen removal from the metal.

The nozzles 25 are built into the side walls 39, just above the junction with the floor 38. Eight nozzles are provided in each side wall. Nozzle-sockets 50 are formed in the refractory material, and tapered plugs 52 are inserted in the sockets 50. The nozzles themselves are cemented into the tapered plugs 52, and the plugs are held in place in the tapered sockets 50 by being pressed into the sockets by springs 53.

The springs abut plates 54, which are held in by studs 56. Mounting the nozzles 25 on springs in this way ensures the nozzles are kept sealed, but minimises the effects of thermal distortions on the (fragile) refractory material.

This manner of mounting the nozzles ensures that the nozzles can be placed close together. Even though the nozzles are securely and yet flexibly mounted, and are reliably sealed, the nozzles can be pitched at about one every 7 or 8 cm, in line along the length of the treatment trough. This close spacing is very effective in filling the whole volume with bubbles to a very high population density, especially when another row of nozzles of the same spacing is present in the opposite wall of the trough.

The bubble-filled zone created by the line of nozzles in the treatment trough preferably should extend right to the ends of the treatment-trough, if the treatment trough is to be of a minimum size. However, if the nozzles are placed too close to the baffles, some of the argon gas can escape out of the ports. It would be wasteful of the treatment zone space if the bubble-filled zone created by the nozzles were less than about 80% of the distance between the baffles.

The baffles 28,29 should be of a relatively thin configuration, whereby the ports 36,37 are short, as compared with the length of the treatment trough. Also, preferably, the troughs outside the baffles should contain liquid with a free surface. In some previous de-gassing systems, liquid metal has been conveyed into or out of the treatment zone through pipes, as distinct from troughs, and the liquid in the pipes has been subjected to a considerable head of pressure. It may be noted that the treatment trough as described herein is simply placed in line as an intermediance between the inlet and outlet troughs, all at more or less the same level. The baffles are thin and the ports are short, and there is no need for sealed pipes, or the like.

The nozzles preferably should be arranged to blow horizontally (plus or minus 15 degrees). The bubbles emerge from the nozzle in quite a tight cone at first, having an included angle of perhaps 20 degrees. As the gas leaves the orifice, it forms large irregular bubbles, which burst into very small bubbles because of the high RN conditions; the bubbles then expand as they take on the temperature and pressure of the surrounding molten metal. As the bubbles decelerate, and expand, and start to rise, the cone angle increases to perhaps 30 degrees.

Because the bubbles are blown in horizontally, the bubbles have little or no upward component to their motion at first, and the bubbles acquire that upwards motion only after they have been retarded in their horizontal motion. Thus, although the bubbles enter the liquid metal at high speed, they quickly lose that speed, and thereafter are available to be caught up and entrained in the violent swirls and turbulence caused by the jetting-in of the subsequent bubbles.

If the nozzles were to point upwards, the bubbles would have some upwards motion upon emerging, and would reach the surface too quickly.

The nozzles should be placed low down in the side walls 38, because any liquid below the level of the nozzles would be relatively still. It is preferable to place the nozzles close to the floor 39 of the trough, rather than to place the nozzles further up the walls and try to angle them downwards. It may be noted from the drawings that the nozzles in the treatment trough are at a horizontal level that is below the floors of the inlet and outlet troughs.

To ensure that there are as few dead areas as possible in the liquid metal in the treatment zone, the nozzles should preferably be arranged so that no point in the liquid is more than about 20 cm away, measured horizontally, from a nozzle.

It should be pointed out that because it is so difficult to observe the conditions when bubbling argon into molten aluminum (at 700 degC.), the observations as described herein of the behaviour of the bubbles are actually an interpretation of analog experiments which are carried out by bubbling air into cold water; the water is contained in a transparent tank, whereby it is easy to observe the manner in which the bubbles move, and to measure bubble size, etc. Molten aluminum has a viscosity that is close enough to that of water to make the analog measurements fairly representational. In this specification, references to bubble size, etc, as measurements, are references to those sizes as measured in water analog experiments.

Figure 4:
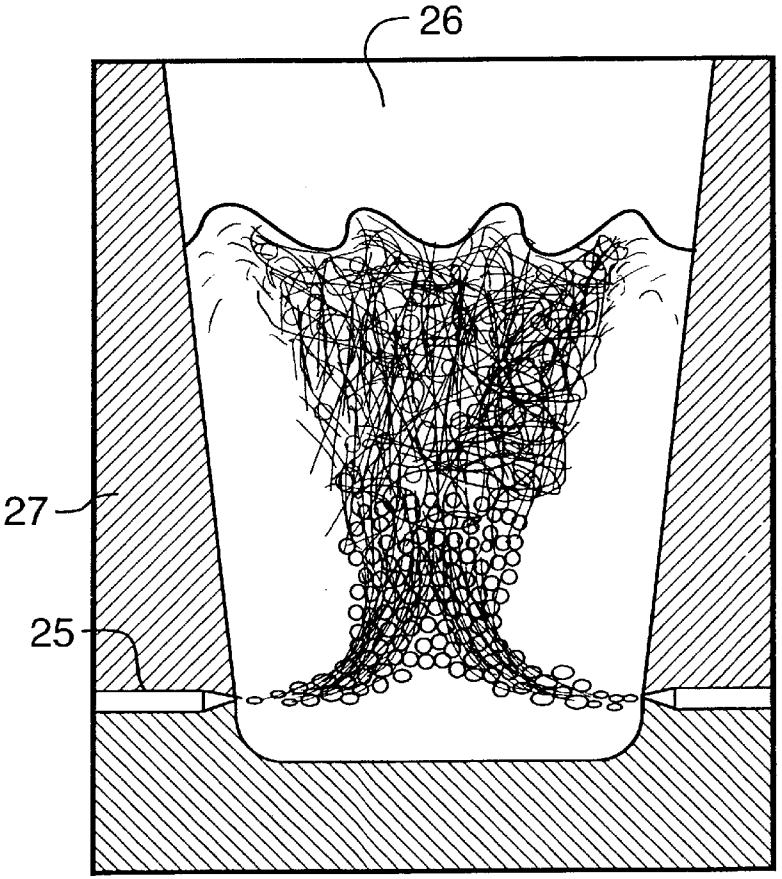
FIG. 4 is a diagrammatic cross-section of a trough, showing the pattern of bubbles emerging from a nozzle.
Figure 5:
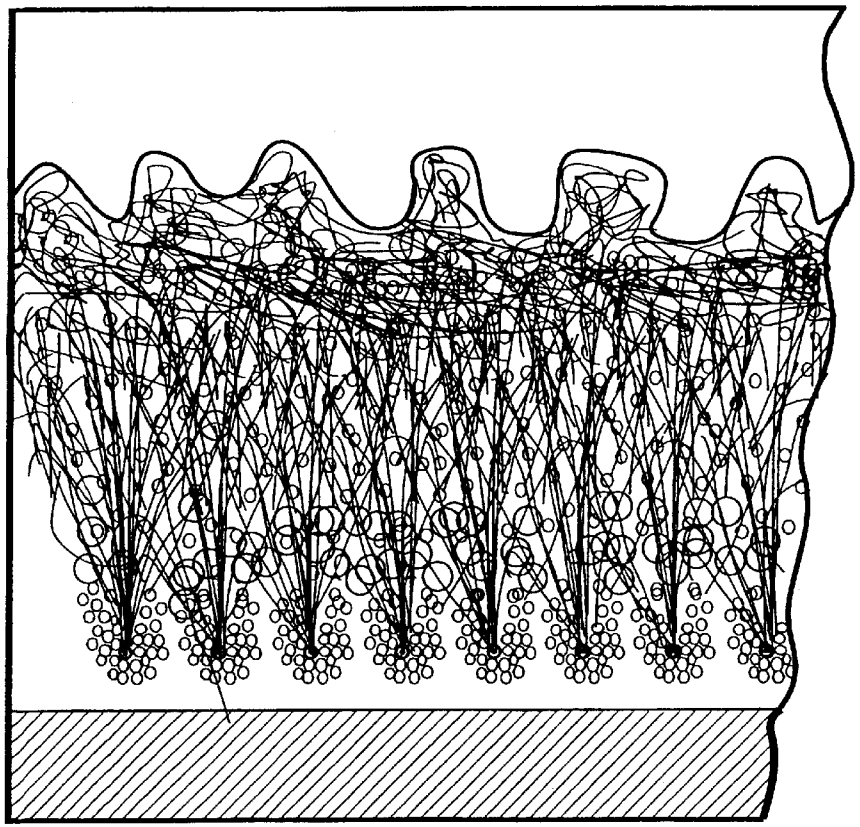
FIG. 5 is a longitudinal view of the same pattern.

FIGS. 4 and 5 illustrate the manner in which the bubbles from the two sides fill the whole width, height, and length of the treatment trough. Of course, this illustration is just diagrammatic: in practice, the bubbles are whirling and swirling in violent and complete turbulence. It may be noted that the foaming surface of the liquid is in a state of constant violent overturning, having peak-to-valley upheavals of 5 cm or more.

The quantity of gas entrained in the bubbles in the liquid is measured as a hold-up of the liquid surface. In the system as described herein, it has been observed that the close-pitching of the nozzles along the length of the trough can produce a hold-up of as much as 25%. That is to say, when the gas is blown through the liquid, so much gas becomes entrained in the liquid that the volume of the liquid and entrained gas combined can be as much as 25% greater than the volume of the liquid on its own. This hold-up may be measured as an increase in the height of the surface of the liquid (inasmuch as the level of the violently heaving and foaming surface can be determined) if the trough has straight vertical sides.

The gas flow rate fed to the nozzles should be enough to give the required degree of hold up and the required gas residence time. A gas flow rate of about 1 gram/min of argon per kg/min flow rate of liquid aluminum should be aimed for. Thus, for an aluminum flow rate of 500 kg/min, the argon gas should be supplied at a flow rate of about 500 grams/min. That is a volumetric flow rate at NTP of about 280 liters/min of argon. The argon would typically be supplied from a pressurised storage reservoir, at about 6 bar.

It is not an essential feature of the invention that the hold-up be as much as 25%. However, if the nozzles were to be so arranged that the hold-up were less than about 15%, the benefits of the invention, of providing a low overall size to the treatment facility, would start to become dissipated. The designer should see to it that the trough dimensions and the nozzle spacing are such that the hold up is at least 15%.

Then, the designer need only provide a trough of a volume capacity that, in relation to the flow rate of liquid metal through the trough, is such as to give a residence time of the liquid metal in the trough of between about 15 and 60 seconds.

It has been found that subjecting liquid metal to a 15% hold up, for 15 seconds, can be enough to achieve adequate degassing. Of course, a greater hold-up, and a longer residence time, may be expected to give better de-gassing performance.

The bubbles of argon can only accept more hydrogen while the hydrogen content of the bubble is small. Once the bubble contains more than a certain quantity of hydrogen, the bubble should be removed from the liquid, and carried away. One of the parameters that promotes efficiency of de-gassing is to make sure all the argon bubbles receive as much hydrogen as possible, before leaving the liquid, and this is where vigorous and violent stirring is beneficial, in that stirring keeps high the hydrogen-gradient, averaged out, of the bubbles.

It is important that the bubbles remain in the liquid for a residence time of no less than about ¾ second. Less than that, and the bubbles emerge with too little hydrogen per bubble, which is wasteful. Directing the nozzles horizontally into a trough of the dimensions as described, can be expected to give a bubble residence time of at least ¾ second.

As mentioned, in seeking to achieve the hydrogen extraction rates that permit the treatment-trough to be so small and economical, it is important that the bubble size of the argon bubbles be small. In this context, small means less than 5 mm diameter. The Reynolds Number of the nozzle orifice determines whether the stream of gas jetting out of the nozzle will break up into small bubbles. The Reynolds Number of an orifice is given by RN=d.u.g/v, where d is the orifice diameter, u is the gas velocity, g is the specific gravity of the gas, and v is the viscosity of the gas.

Tests by E G Leibson et al, A.I.Ch.E,2,296(1956) and by Davidson, PhD Thesis, Columbia U(1951) have shown that for orifices having a RN of 2100 or more, the exiting gas enters the jet flow region and large irregular bubbles are formed at the orifice which explode into small bubbles of different sizes. With an RN above 8000, bubbles with a mean diameter of 5 mm are formed. The mean bubble diameter decreases as the RN increases, and levels out at about 3.8 mm diameter as the RN exceeds 10,000. (The mean bubble diameter is the arithmetic mean of all the bubbles generated within the jet cone.) Preferably, the nozzles in the treatment trough should operate at a RN of 8,000 or more.

Given the sixteen nozzles, and the gas residence times, and the other parameters as described herein, and supplying argon at a readily obtainable pressure of about 6 bars, it turns out that a flow rate through the nozzles (i.e per nozzle) of about 30 grams/min, and a nozzle size of about 0.5 sq mm (0.08 mm diameter), puts the nozzle into the desired range of RN. It will be noted that such an orifice is easy enough to manufacture, and to maintain and keep clean over a long service period.

A text book reference covering these matters is Chapter 20 of Rate *Phenomena in Process Metallurgy*, by Szekely & Themelis.

A further benefit that follows from keeping the treatment zone small, and the residence of the liquid metal short, is that the metal can be expected to drop only a few degrees of temperature in passing through the treatment zone, even though (cold) gas is being bubbled through the liquid. Some previous de-gassing systems have had such long residence times that a heater had to be accommodated in the system.

I claim:

1. Apparatus for de-gassing molten metal, wherein:

the apparatus includes a treatment-trough, made of refractory material, and a means for defining a gas-tight sealed treatment zone, in the treatment-trough;

the apparatus includes a flow of liquid metal through the treatment-trough, and through the treatment-zone;

the treatment-trough is trough-shaped, in that the length of the treatment-zone in the treatment-trough is longer than the width and height of the treatment-trough;

the treatment-trough is provided with a plurality of nozzles, and the nozzles are fixed into the material of the treatment-trough;

the apparatus includes a flow of treatment-gas through the nozzles;

the flow of treatment-gas through the nozzles is of such high speed that the treatment-gas breaks up into streams of small bubbles in the liquid metal;

the nozzles comprise each a respective discrete, single, orifice, and the nozzles are physically separated from each other;

the nozzles are disposed in line, in a series, lengthwise along the length of the treatment-trough, and are so spaced as to create a bubble-filled zone in the liquid metal in the treatment-zone, along the length of the trough;

the treatment-trough comprises left and right side-walls, and a floor, and the nozzles are located in at least one of the side-walls, adjacent to the junction of that wall with the floor;

and the nozzles are so directed that the jets emerge from the nozzles within about +/−15 degrees of horizontal.

2. Apparatus of claim 1, wherein the nozzle orifice size is about 0.5 sq mm, and the gas flow rate per nozzle is at least about 15 grams/min.

3. Apparatus of claim 1, wherein the nozzles are so arranged in the treatment-trough that the bubble-filled-zone occupies at least 80% of the length of the treatment-trough.

4. Apparatus of claim 1, wherein the apparatus includes:

an inlet-trough, and an outlet-trough;

an inlet-baffle between the inlet-trough and the treatment-trough, and an outlet-baffle between the treatment-trough and the outlet-trough;

a treatment-trough-lid, which serves to define a gas-tight sealed treatment zone, comprising the zone inside the treatment trough, between the baffles, and the sealed space above it, under the treatment-trough-lid;

the inlet-baffle includes an inlet-port, and the outlet-baffle includes an outlet port.

5. Apparatus of claim 4, wherein the liquid in the inlet-trough has a free surface and the liquid in the outlet-trough has a free surface, and the level of the free surface of the liquid in the inlet-trough adjacent to the outside of the inlet-baffle is at the same level as, or is slightly higher than, the level of the free surface of the liquid in the outlet-trough adjacent to the outside the outlet-baffle.

6. Apparatus of claim 5, wherein:

the inlet-baffle is a plate of a profile that fits the treatment-trough dimensions, and extends down into the trough, and is shaped to fit and fill the cross-section of the treatment-trough;

and the outlet-baffle is another plate of a profile that fits the treatment-trough dimensions, and extends down into the trough, and is shaped to fit and fill the cross-section of the treatment-trough.

7. Apparatus of claim 4, wherein the treatment trough is so arranged that the liquid in the treatment-trough is of approximately constant depth and constant width, between the baffles.

8. Apparatus of claim 4, wherein the treatment-trough is straight, and the treatment-trough is, in substance, an in-line intermediance between the inlet-trough and the outlet-trough.

9. Apparatus of claim 4, wherein the inlet and outlet ports in the treatment trough are at approximately the same horizontal level.

10. Apparatus of claim 4, wherein the inlet-baffle is thin and the inlet-port is short, and the outlet-baffle is thin and the outlet-port is short, compared to the length L of the treatment-trough.

11. Apparatus of claim 1, wherein the nozzles are disposed half the number of nozzles in the left-side-wall and the other half in the right-side-wall.

12. Apparatus of claim 1, wherein the nozzles are between four and twenty in total number.

13. Apparatus of claim 1, wherein the nozzles in the side-wall are spaced no more than about 8 cm apart.

14. Apparatus of claim 1, wherein the nozzles are pitched along the length of the treatment-trough a distance apart that is no more than ⅓ the width of the trough.

15. Apparatus of claim 4, wherein the inlet trough and the outlet trough have respective floors, and the horizontal level of the nozzles is lower than the floors of the inlet-trough and of the outlet-trough.

16. Apparatus of claim 1, wherein the apparatus includes a means for maintaining the treatment zone at an elevated pressure during treatment.

17. Apparatus of claim 1, wherein the apparatus is so arranged that the liquid metal, in passing through the treatment-zone, is subject to natural cooling, in that the apparatus includes no means for heating the liquid metal in the treatment zone.

18. Apparatus of claim 6, wherein:

the treatment-trough is straight, and the treatment-trough is, in substance, an in-line intermediance between the inlet-trough and the outlet-trough;

the inlet and outlet ports in the treatment trough are at approximately the same horizontal level;

the inlet-baffle is thin and the inlet-port is short, and the outlet-baffle is thin and the outlet-port is short, compared to the length L of the treatment-trough;

the nozzles are between four and twenty in total number;

the nozzles in the side-wall are spaced no more than about 8 cm apart;

the nozzles are pitched along the length of the treatment-trough a distance apart that is no more than ⅓ the width of the trough;

the width of the trough is such that none of the liquid in the bubble-filled-zone is more than about 20 cm horizontally from one of the nozzles;

the horizontal level of the nozzles is lower than the floors of the inlet-trough and of the outlet-trough;

the apparatus includes a means for maintaining the treatment zone at an elevated pressure during treatment;

the apparatus is so arranged that the liquid metal, in passing through the treatment-zone, is subject to natural cooling, in that the apparatus includes no means for heating the liquid metal in the treatment zone.

19. Apparatus of claim 1, wherein:

in respect of each nozzle, the nozzle has an orifice Reynolds Number of at least 8,000;

in respect of each nozzle, the orifice size and gas flow rate are such that the bubbles have a mean bubble diameter of 5 mm or less;

the nozzle orifice size is about 0.5 sq mm, and the gas flow rate per nozzle is at least about 15 grams/min;

the liquid-metal-flow-rate and the volume of the bubble-filled-zone, are such that the liquid metal stays in the bubble-filled-zone for a liquid-residence-time of at least about 15 seconds;

the liquid-metal-flow-rate and the volume of the bubble-filled-zone, are such that the liquid metal stays in the bubble-filled-zone for a liquid-residence-time of no more than about 60 seconds;

per kilogram/min of liquid-metal-flow-rate, the gas-flow-rate is about 1 gram/min;

the gas-flow-rate, and the volume of the bubble-filled-zone, and the arrangement of the nozzles, are such that the gas stays in the bubble-filled-zone for a gas-residence-time of at least about ¾ second;

the gas-flow-rate, and the volume of the bubble-filled-zone, and the arrangement of the nozzles, are such that the gas stays in the bubble-filled-zone for a gas-residence-time of no more than about two seconds;

the gas-flow-rate and the arrangement of the nozzles is such that, in the volume VL of the liquid metal in the bubble-filled-zone, the aggregate volume VG of the gas bubbles entrained therein is at least 15% of VL;

the gas-flow-rate and the arrangement of the nozzles is such as to create a hold-up of at least 15%, in that the presence of the bubbles of gas in the liquid raises the level of the liquid surface by at least 15%;

per 500 kg/min of flow rate of liquid metal, the length of the treatment-trough is at least about 80 cm, and the treatment-trough contains a volume of liquid metal of about 40 liters;

the nozzles are so arranged in the treatment-trough that the bubble-filled-zone occupies at least 80% of the length of the treatment-trough;

the flow rate of the liquid metal being FL liters/minute, the volume VL of liquid metal containing bubbles in the bubble-filled zone is less than about ½ FL liters.

20. Apparatus of claim 18, wherein:

in respect of each nozzle, the nozzle has an orifice Reynolds Number of at least 8,000;

in respect of each nozzle, the orifice size and gas flow rate are such that the bubbles have a mean bubble diameter of 5 mm or less;

the nozzle orifice size is about 0.5 sq mm, and the gas flow rate per nozzle is at least about 15 grams/min;

the liquid-metal-flow-rate and the volume of the bubble-filled-zone, are such that the liquid metal stays in the bubble-filled-zone for a liquid-residence-time of at least about 15 seconds;

the liquid-metal-flow-rate and the volume of the bubble-filled-zone, are such that the liquid metal stays in the bubble-filled-zone for a liquid-residence-time of no more than about 60 seconds;

per kilogram/min of liquid-metal-flow-rate, the gas-flow-rate is about 1 gram/min;

the gas-flow-rate, and the volume of the bubble-filled-zone, and the arrangement of the nozzles, are such that the gas stays in the bubble-filled-zone for a gas-residence-time of at least about ¾ second;

the gas-flow-rate, and the volume of the bubble-filled-zone, and the arrangement of the nozzles, are such that the gas stays in the bubble-filled-zone for a gas-residence-time of no more than about two seconds;

the gas-flow-rate and the arrangement of the nozzles is such that, in the volume VL of the liquid metal in the bubble-filled-zone, the aggregate volume VG of the gas bubbles entrained therein is at least 15% of VL;

the gas-flow-rate and the arrangement of the nozzles is such as to create a hold-up of at least 15%, in that the presence of the bubbles of gas in the liquid raises the level of the liquid surface by at least 15%;

per 500 kg/min of flow rate of liquid metal, the length of the treatment-trough is at least about 80 cm, and the treatment-trough contains a volume of liquid metal of about 40 liters;

the nozzles are so arranged in the treatment-trough that the bubble-filled-zone occupies at least 80% of the length of the treatment-trough;

the flow rate of the liquid metal being FL liters/minute, the volume VL of liquid metal containing bubbles in the bubble-filled zone is less than about ½ FL liters.

21. Method for de-gassing molten metal, comprising the steps of, providing a treatment-trough, made of refractory material, and a means for defining a gas-tight sealed treatment zone, in the treatment-trough;

providing a flow of liquid metal through the treatment-trough, and through the treatment-zone;

providing the treatment-trough as trough-shaped, in that the length of the treatment-zone in the treatment-trough is longer than the width and height of the treatment-trough;

providing the treatment-trough with a plurality of nozzles, the nozzles being fixed into the material of the treatment-trough;

providing a flow of treatment-gas through the nozzles, of such high speed that the treatment-gas breaks up into streams of small bubbles in the liquid metal;

wherein the nozzles comprise each a respective discrete, single, orifice, and the nozzles are physically separated from each other;

disposing the nozzles in line, in a series, lengthwise along the length of the treatment-trough, and so spacing the nozzles as to create a bubble-filled zone in the liquid metal in the treatment-zone, along the length of the trough;

wherein the treatment-trough comprises left and right sidewalls, and a floor;

locating the nozzles in at least one of the side-walls, adjacent to the junction of that wall with the floor;

and so directing the nozzles that the jets emerge from the nozzles within about +/−15 degrees of horizontal.

22. Method of claim 21, including the step, in respect of each nozzle, of so passing the gas through the nozzle that the nozzle has an orifice Reynolds Number of at least 8,000.

23. Method of claim 22, including the step, in respect of each nozzle, of so passing the gas through the nozzle that the nozzle has an orifice Reynolds Number of about 10,000.

24. Method of claim 21, including the step, in respect of each nozzle, of so arranging the orifice size and gas-flow-rate that the bubbles have a mean bubble diameter of 5 mm or less.

25. Method of claim 21, including the step of so arranging the liquid-metal-flow-rate, and the volume of the bubble-filled-zone, that the liquid metal stays in the bubble-filled-zone for a liquid-residence-time of at least about 15 seconds.

26. Method of claim 21, including the step of so arranging the liquid-metal-flow-rate and the volume of the bubble-filled-zone, that the liquid metal stays in the bubble-filled-zone for a liquid-residence-time of no more than about 60 seconds.

27. Method of claim 21, including the step of providing the gas at a gas-flow-rate of about 1 gram/min, per kilogram/min of liquid-metal-flow-rate.

28. Method of claim 21, including the step of so arranging the gas-flow-rate, and the volume of the bubble-filled-zone, and the nozzles, that the gas stays in the bubble-filled-zone for a gas-residence-time of at least about ¾ second.

29. Method of claim 21, including the step of so arranging the gas-flow-rate, and the volume of the bubble-filled-zone, and the nozzles, that the gas stays in the bubble-filled-zone for a gas-residence-time of no more than about two seconds.

30. Method of claim 21, including the step of so arranging the gas-flow-rate and the nozzles that, in the volume VL of the liquid metal in the bubble-filled-zone, the aggregate volume VG of the gas bubbles entrained therein is at least 15% of VL.

31. Method of claim 21, including the step of so arranging the gas-flow-rate and the nozzles as to create a hold-up of at least 15%, in that the presence of the bubbles of gas in the liquid raises the level of the liquid surface by at least 15%.

32. Method of claim 21, including the step of providing the trough in such dimensions that, per 500 kg/min of flow rate of liquid metal, the length of the treatment-trough is at least about 80 cm, and the treatment-trough contains a volume of liquid metal of about 40 liters.

33. Method of claim 21, including the step of ensuring that the volume VL of liquid metal containing bubbles in the bubble-filled zone is less than about ½ FL liters, where FL liters/min is the flow rate of the liquid metal.

34. Method of claim 21, including the step of providing the trough in such dimensions that none of the liquid in the bubble-filled-zone is more than about 20 cm horizontally from one of the nozzles.

* * * * *